US007073884B2

(12) United States Patent
Ueda

(10) Patent No.: US 7,073,884 B2
(45) Date of Patent: Jul. 11, 2006

(54) INK JET HEAD AND INK JET PRINTER

(75) Inventor: Masato Ueda, Hino (JP)

(73) Assignee: Konica Corporation, Tokyo (JP)

( * ) Notice: Subject to any disclaimer, the term of this patent is extended or adjusted under 35 U.S.C. 154(b) by 125 days.

(21) Appl. No.: 10/648,534

(22) Filed: Aug. 25, 2003

(65) Prior Publication Data

US 2004/0119773 A1 Jun. 24, 2004

(30) Foreign Application Priority Data

Aug. 30, 2002 (JP) ..... 2002-256055

(51) Int. Cl.
*B41J 2/015* (2006.01)
*B41J 2/14* (2006.01)
*B41J 29/13* (2006.01)

(52) U.S. Cl. ..... 347/20; 347/49; 347/108

(58) Field of Classification Search ..... 347/47, 347/44, 40, 20, 9, 1, 7, 5, 84, 85, 86, 54, 347/57, 56, 55, 12, 42, 49, 50, 68–72, 108; 29/890.1

See application file for complete search history.

(56) References Cited

U.S. PATENT DOCUMENTS

| | | | | |
|---|---|---|---|---|
| 5,804,083 | A * | 9/1998 | Ishii et al. | 216/2 |
| 6,027,208 | A * | 2/2000 | Amano | 347/70 |
| 6,623,100 | B1 * | 9/2003 | Baitz et al. | 347/37 |
| 2002/0024560 | A1 * | 2/2002 | Misumi et al. | 347/57 |

* cited by examiner

*Primary Examiner*—Manish Shah
*Assistant Examiner*—Geoffrey S. Mruk
(74) *Attorney, Agent, or Firm*—Squire, Sanders & Dempsey, L.L.P.

(57) ABSTRACT

An ink jet head having: a nozzle tip having a front end surface in which a nozzle for jetting ink is provided, and four side surfaces adjacent to a back end surface which is opposite to the nozzle; and a frame shape member on which the nozzle tip is mounted, the frame shape member having a first protrusion pair each of which abuts on one pair of facing sides of the four side surfaces to sandwich the nozzle tip, and a second protrusion pair which abuts on the other pair of facing sides of the four side surfaces to sandwich the nozzle tip.

26 Claims, 8 Drawing Sheets

INK JET HEAD AND INK JET PRINTER

BACKGROUND OF THE INVENTION

1. Field of the Invention

The present invention relates to an ink jet head and an ink jet printer.

2. Description of the Related Art

An ink jet printer jetting ink on a recording medium such as a sheet, a plastic thin plate or the like to record a predetermined image has been proposed and been in practical use. The ink jet printer comprises an ink jet head having a nozzle (ink jetting opening), the ink jet printer jets ink from the nozzle toward a recording medium while moving the ink jet head in a predetermined direction to record a predetermined image on the recording medium.

For example, Japanese Patent Laid-open Application No. 2002-46256 discloses such ink jet head.

FIG. 8 is an exploded perspective view for explaining a structure of a portion near a nozzle of an ink jet head according to an earlier technique developed by the applicant of the present invention. As shown in FIG. 8, the portion in the vicinity of the nozzle comprises a frame 110, a nozzle chip 120, a flexible wiring substrate 130 and the like.

The frame 110 is fixed in a state properly positioned to have a predetermined positioning relation to a carriage which is not shown in the figure, and moves together with the carriage in a predetermined direction. The frame 110 is fixed in a state positioned to the carriage so that displacement of an ink jetting position can be prevented. Further, in the frame 110, an opening 111 for fixing the nozzle chip 120 is formed.

The nozzle chip 120 is a thin plate shape member as shown in FIG. 8, and comprises a nozzle at a front end portion 121 with openings for jetting ink. The portion near the front end portion 121 of the nozzle chip 120 is inserted to the opening 111 of the frame 110 to be fixed to the frame 110.

To prevent displacement of the ink jetting position and to form a high quality image, it is required to fix the nozzle chip 120 in a state properly positioned to have a predetermined positional relation to the frame 110.

In the earlier technique, the following method is adopted to carry out a positioning of the nozzle chip 120. The inner shape of the opening 111 of the frame 110 is formed slightly larger than the outer shape of the front end portion 121, and protrusions 113 are provided at short sides of the inner shape 112 of the opening 111 of the frame 110. The positioning is carried out based on only one of the protrusions 113 and one of the long sides of the inner shape 114. A long side sulfate 122 of the front end portion 121 of the nozzle chip 120 is abutted on one of the long sides of the inner shape 114 of the opening 111 in the frame 110 in a state pressing to the long side of the inner shape 114 and is adhered to be fixed.

However, when the above-mentioned positioning is adopted, the positioning accuracy is relatively low because the positioning of the nozzle chip 120 is carried out by adjusting the position of the nozzle chip 120 based on only one of the protrusions 113 and one of the long sides of the inner shape 114.

Generally, the frame 110 is made of metal material such as aluminum or the like by die-casting. However, in the above-described positioning in the earlier technique, it is required to form the protrusions 113 on the short sides of the inner shape 112 of the opening 111 in the frame 110 by cutting process. Moreover, fine adjustment is required by performing cutting process in a wide area of the long sides of the inner shape 114. This results in requiring a lot of time and large costs for cutting process.

SUMMARY OF THE INVENTION

An object of the invention is to improve the positioning accuracy of a nozzle chip to a flame, and to reduce the time and cost for cutting process of the frame in an ink jet head.

Another object of the invention is to provide an ink jet printer having the above-mentioned ink jet head.

In accordance with a first aspect of the present invention, the ink jet head comprises:

a nozzle chip comprising a front end surface in which a nozzle for jetting ink is provided, and four side surfaces adjacent to a back end surface which is opposite to the nozzle; and a frame shape member on which the nozzle chip is mounted, the frame shape member comprising a first protrusion pair which abuts on one pair of facing sides of the four side surfaces to sandwich the nozzle chip and a second protrusion pair which abuts on the other pair of facing sides of the four side surfaces to sandwich the nozzle chip.

According to the ink jet head, the first protrusion pair abuts on the one pair of facing sides of the four side surfaces of the nozzle chip to sandwich the nozzle chip and the second protrusion pair abuts on the other pair of facing sides of the four side surfaces of the nozzle chip to sandwich the nozzle chip. Thus the nozzle chip can be positioned properly to the frame shape member in a horizontal direction.

In addition, according to the ink jet head, since the nozzle chip can be positioned properly only by forming the first protrusion pair and the second protrusion pair by carrying out cutting process on the frame shape member, it is unnecessary to carry out cutting process in wide area on the frame shape member as the earlier technique. Accordingly, the time and cost for cutting process are extremely reduced.

In accordance with a second aspect of the present invention, the ink jet printer comprises:

an ink jet head which comprises a nozzle chip comprising a front end surface in which a nozzle for jetting ink is provided and four side surfaces adjacent to a back end surface which is opposite to the nozzle, and a frame shape member comprising a first protrusion pair which abuts on one pair of facing sides of the four side surfaces to sandwich the nozzle chip and a second protrusion pair which abuts on the other pair of facing sides of the four side surfaces to sandwich the nozzle chip, for mounting the nozzle chip; and a carriage on which the ink jet head is mounted in pro-positioned state.

According to the ink jet printer, since the ink jet head is mounted to the carriage in a pre-positioned state, the relative position relation of the nozzle chip to the carriage can be fixed. Thus, displacement of the ink jetting position can be prevented and an image with a high accuracy can be formed.

Preferably, in the ink jet head or the ink jet printer, the nozzle chip comprises an electrode terminal on a central portion of the one pair of facing sides, and the first protrusion pair abuts on a portion of the one pair of facing sides on which no electrode terminal is provided to sandwich the nozzle chip.

The central portion means a certain region which includes the center of the one pair of facing sides.

According to the structure, since the first protrusion pair abuts on a portion of the one pair of facing sides on which no electrode terminal is provided to sandwich the nozzle chin, the nozzle chip can be positioned to the frame shape member more properly, and this allows other members to be connected to the electrode terminal.

Preferably, the frame shape member comprises an abutment portion on which the back end surface of the nozzle chip abuts.

According to the structure, since the frame shape member comprises the abutment portion on which the back end surface of the nozzle chip abuts, the nozzle chip can be positioned properly to the frame shape member in a vertical direction.

Preferably, the frame shape member comprises a first protrusion member and a second protrusion member on inner walls of both ends of the frame shape member, respectively, so as to face each other, the first protrusion member cornicing the first protrusion pair and one protrusion of the second protrusion pair, the second protrusion member comprising the first protrusion pair and the other protrusion of the second protrusion pair.

Preferably, each of the first protrusion member and the second protrusion member further comprises an abutment porlion on which the back end surface of the nozzle chip abuts.

Preferably, the first protrusion pair is arranged on the abutment portion perpendicularly.

Preferably, the second protrusion pair is arranged on the abutment portion perpendicularly.

Preferably, the frame shape member is made of at least one material selected from alumina, resin, magnesium and silver.

Preferably, the frame shape member is formed as one body by die-casting.

Preferably, the first protrusion pair and the second protrusion pair are formed by cutting process.

Preferably, the nozzle chip has a thin plate shape.

Preferably, the back end surface of the nozzle chip has a umform width.

The uniform width is not limited to the proper sense of the word. Thus, the bask end surface of the nozzle chip may have an approximately uniform width.

Preferably, a width of the back end surface of the nozzle chip is smaller than a width of the front end surface.

Preferably, a piezoelectric element of shear mode type is built in the ink jet head.

According to the structure, the outer shape and the back end surface of the nozzle chip can be formed at a time of forming a groove, so that the positioning accuracy of the nozzle chip to a housing frame can be improved.

Preferably, the back end surface of the nozzle chip has a umform width.

The uniform width is not limited to the proper sense of the word. Thus, the bask end surface of the nozzle chip may have an approximately uniform width.

Preferably, a width of the back end surface of the nozzle chip is smaller than a width of the front end surface.

Preferably, a piezoelectric element of shear mode type is built in the ink jet head.

According to the structure, the outer shape and the back end surface of the nozzle chip can be formed at a time of forming a groove, so that the positioning accuracy of the nozzle chip to a housing frame can be improved.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 6B is an enlarged view of the B portion in. FIG. 6A;

DETAILED DESCRIPTION OF THE PREFERRED EMBODIMENTS

Hereinafter, the preferred embodiments of the present invention will be described in detail by reference to the attached drawings.

First Embodiment

Figure 1:
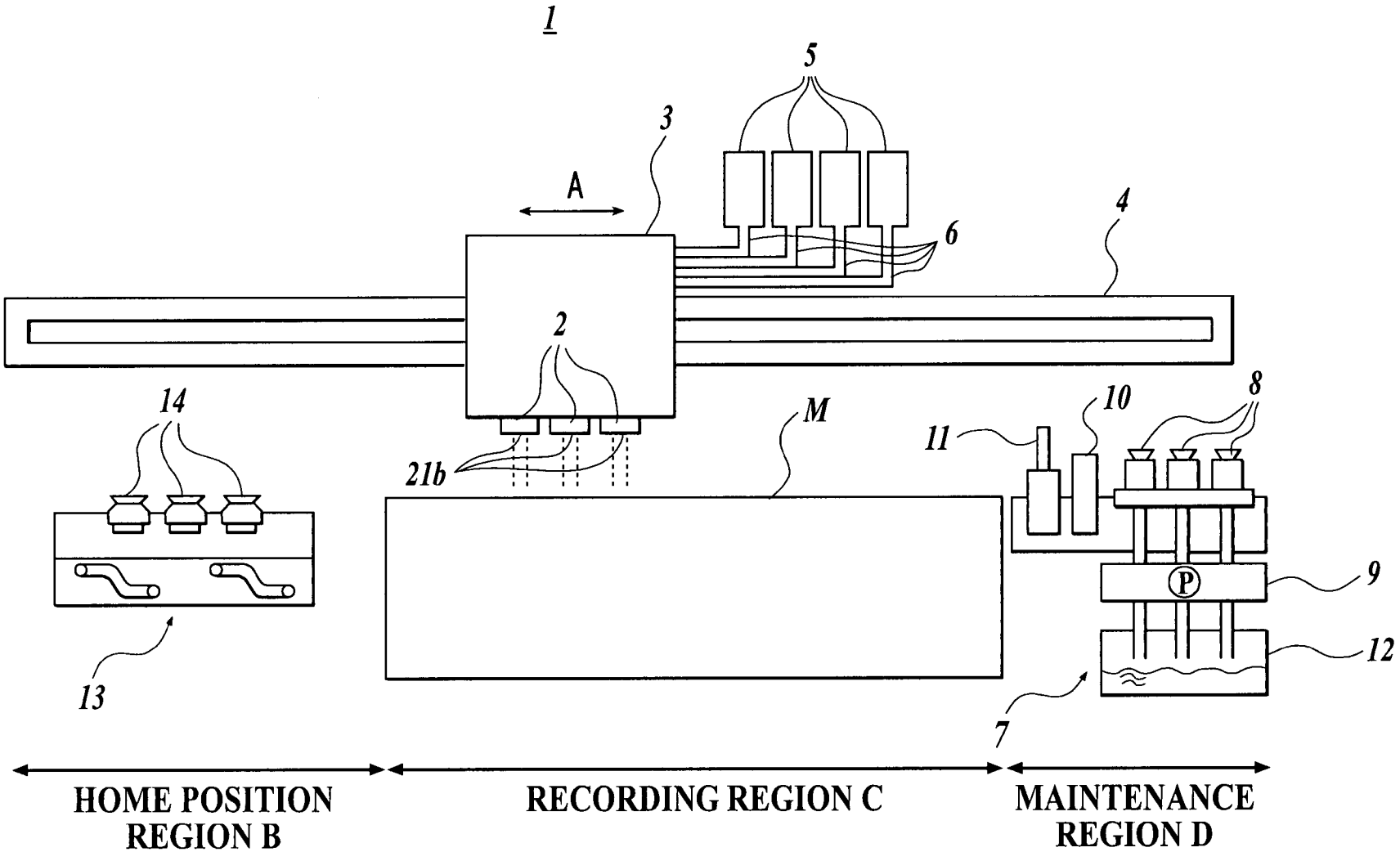
FIG. 1 is a schematic view for explaining an ink jet printer according to the first embodiment of the present invention.

A structure of an ink jet printer 1 according to the present embodiment will be described referring to FIG. 1. FIG. 1 is a schematic view for explaining the structure of the ink jet printer 1 according to the embodiment. As shown in FIG. 1, the ink jet printer 1 comprises a ink jet head 2, a carriage 3, a carriage rail 4, an ink tank 5, an ink supply tube 6, a maintenance unit 7, a moisture retaining unit 13 and the like. The ink jet printer 1 jets ink onto a predetermined it cording medium M to form a predetermined image on the recording medium M.

The recording medium M on which an image is formed by the ink jet printer 1 is adapted to pass through a recording region C in FIG. 1, and is carried by a carrying section (not shown) in a sub scanning direction which is perpendicular to the direction of an arrow A (hereinafter referred to as a "main scanning direction") in FIG. 1.

The ink jet head 2 comprises a nozzle for jetting ink. An image is formed on the recording medium M by jetting ink in tandem with the scanning of the carriage 3 by reciprocating movement in the recording region C. The ink jet head 2 is mounted to the carriage 3 in a state that a nozzle side surface 21*b*(described below) on which nozzles for jetting ink are arranged in parallel is disposed to face the recording medium M.

In the embodiment, a piezoelectric element of shear mode type is built in the ink jet head 2.

In an ink jet head of the shear mode type, grooves are mechanically formed on PZT (piezoelectric) substrate made of a piezoeledtric material by using a dicing saw or the like to form an actuator by a channel and a channel wall. A cover plate is attached on an upper surface of the actuator, and a nozzle plate is attached on a front surface of the actuator, respectively. Then, ink is filled in the channel. Voltage is applied to a driving electrode which is formed on both surface of the actuator, so that shearing stress is generated so as to fransform the actuator in a direction in which the volume of the channel shrinks. Thus, an inner pressure increases and ink is jetted from a nozzle as droplets.

The ink jet head 2 can be placed in vertical position for use to make the ink jetting direction of the nozzle be in vertically downward direction, or in horizontal position for use to make the ink jetting direction of the nozzle be in horizontal direction.

In the ink jet printer 1 according to the embodiment there are totally four ink jet heads 2 mounted on the carriage 3 to jet four colors of inks, i.e., black (K), yellow (Y), magenta (M) and cyan (C). The four ink jet heads 2 are arranged in three lines from the view of the sub scanning direction shown in FIG. 1, and two ink jet heads 2 are assigned in the middle line, adjoining to each other in the sub scanning direction.

A detail structure of the ink jet head 2 according to the embodiment will hereinafter be described referring to FIGS. 2–6B.

The ink jet head 2 is mounted on the carriage 3. The carriage 3 moves from a home position region B to a inaintenance region D in a main scanning direction A along the carriage rail 4. In the recording region C, the main scanning is carried out on the recording medium M by a movement of the carriage 3.

The ink tank 5 is for storing ink which is supplied to the ink jet head 2, and there are four ink tanks 5 mounted corresponding to each of the four ink jet heads 2. The ink supply tube 6 is provided so as to communicate the ink jet head 2 with the ink tank 5. The ink in the ink tank 5 is in produced into the ink jet heads 2 through the ink supply tube 6.

The maintenance unit 7 is for removing foreign objects in the ink jet head 2 by a series of maintenance operations, and for recovering a good condition of the ink jet head 2 for jetting ink. The maintenance unit 7 mounted in the maintenance region D comprises a suction cap 8, a suction pump 9, an ink reservoir 10, a cleaning blade 11, a waste ink tank 12 and the like.

The suction cap 8 communicates with the waste ink tank 12 through the suction pump 9 and is raised when in maintenance operation to cover the nozzle side surface 21*b* of the ink jet head 2. There are four suction caps 8 mounted so as to cover the nozzle side surface 21*b* of each of the ink jet heads 2.

The suction pump 9 comprises a cylinder pump or a rube pump which is not shown in the figure, and generates a suction power to suction ink inside of the ink jet head 2 with foreign objects. The suction pump 9 is operated with the nozzle side surface 21*b* of the ink jet head 2 covered by the suction cap 8 so as to suction the ink inside of the ink jet head 2.

The ink reservoir 10 is for reserving ink pre-jetted by the ink jet head 2 after ink inside the ink jet head 2 was sectioned. The cleaning blade 11 is for removing ink which attaches on the nozzle side surface 21*b* after pie-jetting ink by the ink jet head 2. The waste ink tank 12 functions to store ink which was sectioned from the, ink jet head 2 by an operation of the suction pump 9 or pre-jetted from the ink jet head 2.

The moisture retaining unit 13 is disposed in the home positioning region B, and comprises a moisture retaining cap 14. The moisture retaining cap 14 functions to retain moiture of ink inside the nozzle by covering the nozzle side surface 21*b* when the ink jet head 2 is on standby. There are four moisture retaining caps 14 provided so as to cover the nozzle side surtce 21*b* of each of the ink jet heads 2.

Figure 2:
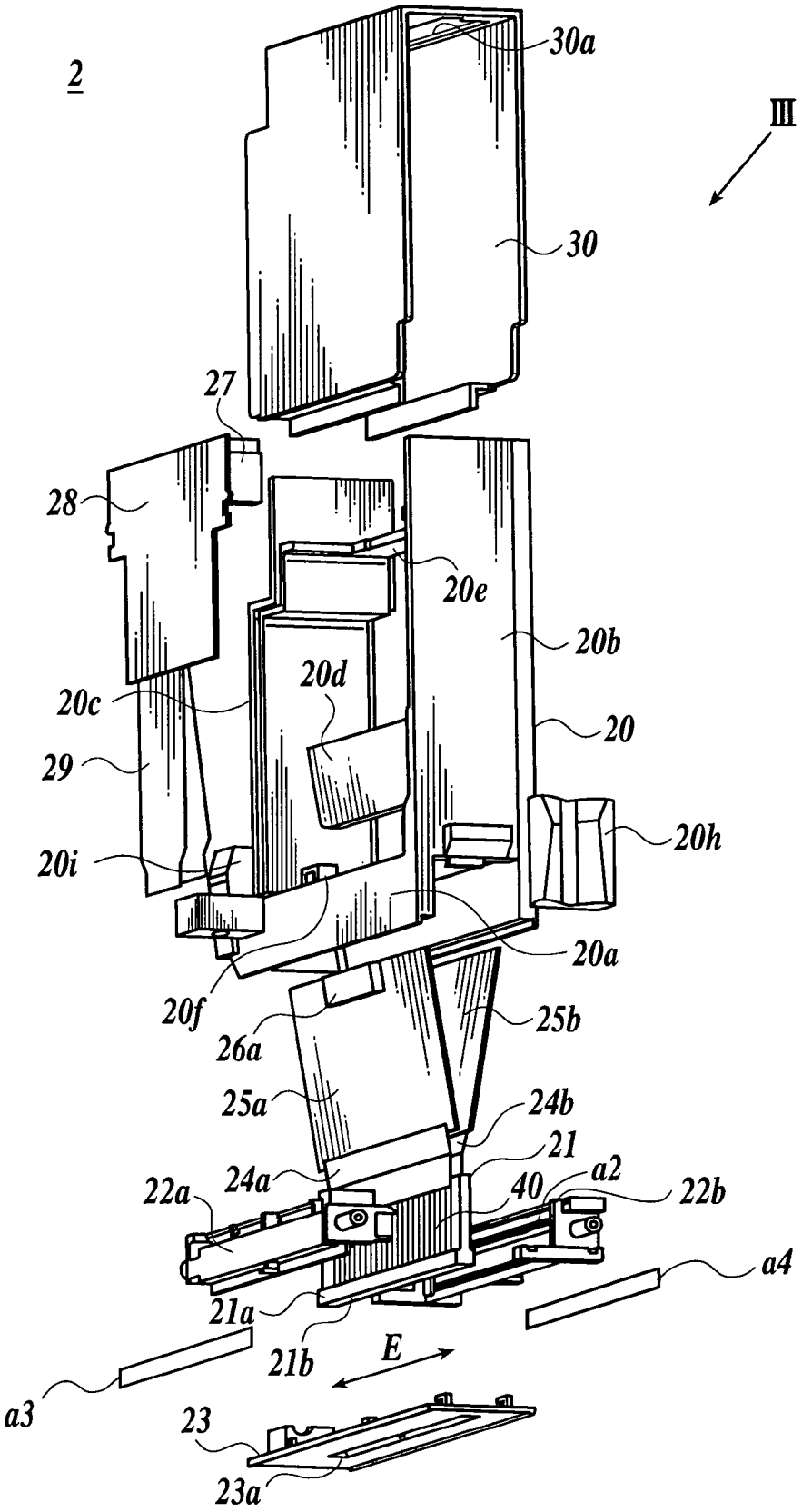
FIG. 2 is an exploded perspective view of the ink jet head according to the first embodiment of the present invention.

A structure of the ink jet head 2 according to the embodiment will be described referring to FIGS. 2–6B. FIG. 2 is an exploded perspective view of the ink jet head 2 according to the embodiment, and FIG. 3 is an exploded perspective view of the ink jet head shown in FIG. 2 as seen from the back side (the direction of the arrow III in FIG. 2).

Figure 3:
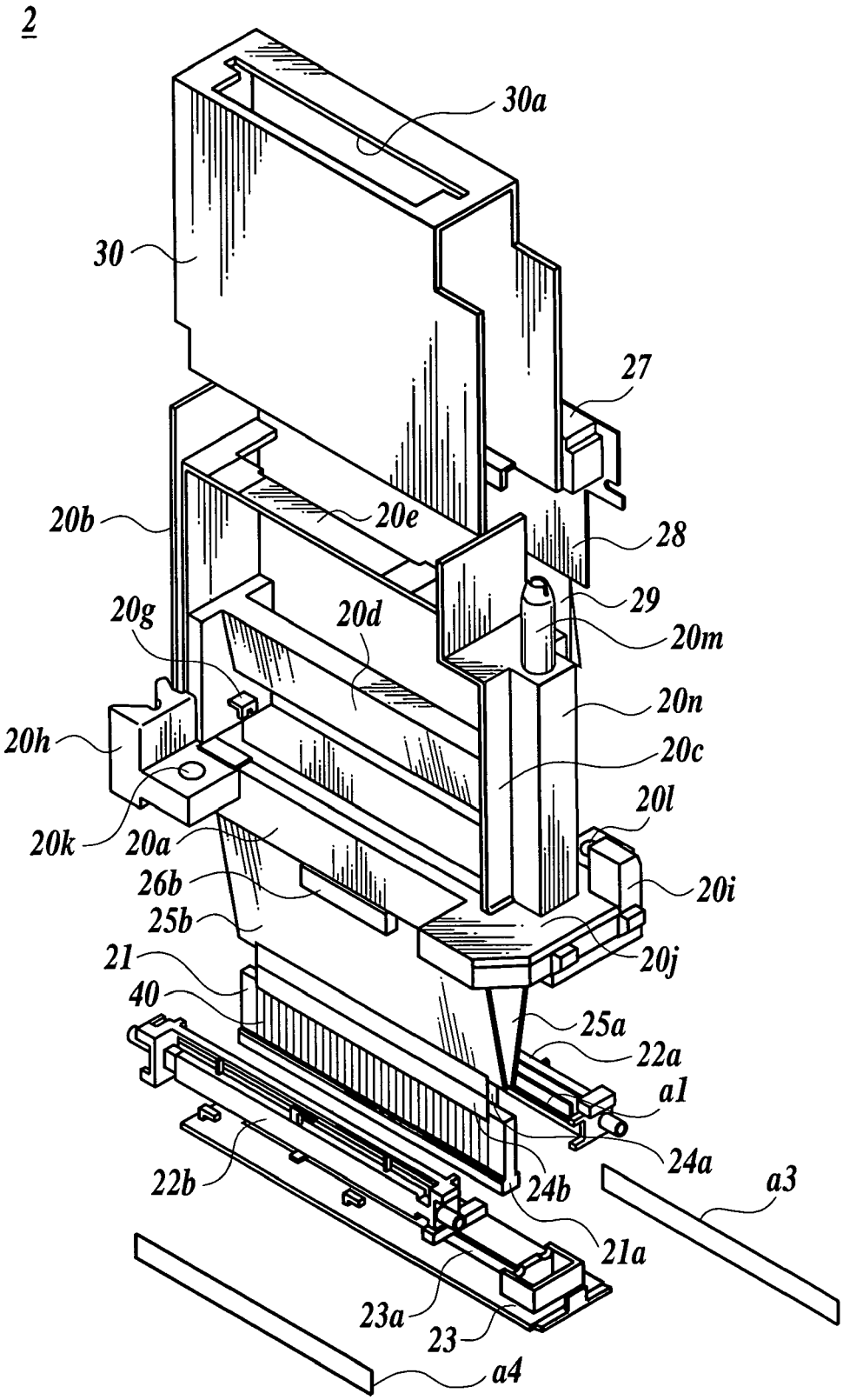
FIG. 3 is an exploded perspective view of the ink jet head shown in FIG. 2 seen from the direction of the arrow III.

The ink jet head 2 according to the embodiment, as shown in FIG. 2 and 3, comprises the housing frame 20, the nozzle chip 21, two manifolds 22*a*, 22*b*, a cap receiving plate 23, a first flexible wiring substrates 24*a*, 24*b*, driving circuit substrates 25*a*, 25*b*, internal connectors 26*a*, 26*b*, an external connector 27, a wiring supporting plate 28, a second flexible wiring substrate 29 and a cover 30.

The housing frame 20 is a frame shape member in the present invention, and is formed as one body by die-casting using aluminum, resin, magnesium, silver or the like. The housing frame 20 comprises a base frame portion 20*a* for housing the nozzle chip 21, the manifolds 22*a*, 22*b* and the cap receiving plate 23, side wall portions 20*b*, 20*c* each of which is vertically arranged from each end of a longitudinal direction of the base frame portion 20% a heat radiation plate 20*d* and a connector supporting portion 20*e* which are formed to be crossed over the side wall portions 20*b*, 20*c*, and nozzle chip sandwiching portions 20*f*, 20*g* each of which are formed inside of the side wall portions 20*b*, 20*c*.

The manifolds 22*b*, 22*c*, and the cap receiving plate 23 are fixed on the base frame portion 20*a* with an adhesive. Each of the nozzle chip sandwiching portions 20*f*, 20*g*, as hereinafter described in detail, are for sandwiching and holding each end of the back end portion 21*c* of the nozzle chip 21. The heat radiation plate 20*d* is for joining the driving circuit substrates 25*a*, 25*b*. The connector supporting portion 20*e* functions to support the external connector 27.

On a periphery of the base frame portion 20*a*, three abutment supporting portions 20*a*, 20*i*, 20*j*, and two bolt insertion holes 20*k*. 201 are provided. The three abutment supporting portions 20*b*, 20*i*, 20*j* abut on three supporting points of the carriage 3 to be supported when the ink jet head 2 is positioned to the carriage 3. After the positioning, the bolt to fix the ink jet head 2 to the carriage 3 is inserted through the bolt insertion holes 20*k*, 20*l*.

An ink flow pat connector 20*m* which admits ink from outside is formed on the housing frame 20. The ink flow pat connector 20*m* communicates with an ink flow pat inside of an ink flow pat forming portion 20*n* which is disposed ante side wall 20*c*. The ink flow path inside of the ink flow path forming portion 20*n* is connected to an ink flow path which is Conned in each of the manifolds 22*a* 22*b*. The ink is led tote ink flow path of each of the manifolds 22*a*, 22*b* through the ink flow pat connector 20*m* and the ink flow pat inside of the ink flow pat forming portion 20*n*, and is admitted to each nozzle of the nozzle chip 21.

The nozzle chip 21 according to the present invention is a thin plate shape member comprising a plurality of nozzles at the front end portion 21*a*. A nozzle wit openings for jetting ink is continuously formed in the direction of the arrow E (hereinafter described as a "nozzle arranged direction E") in FIG. 2 at the front end surface 21*b* (hereinafter described as a "nozzle side surface") of the front end partion 21*a* of the nozzle chip. A line of nozzles which is continuously Conned in the nozzle arranged direction E is hereinafter described as a "nozzle line". The ink jet head 2 comprises two nozzle lines.

The nozzle chip 21 has an oblong outer shape in the nozzle arranged direction E, and is mounted on the carriage 3 so as to have the nozzle arranged direction E perpendicular to the main scanning direction A. An electrode (electrode terminal) 40 for connecting each of the first flexible wiring substrate 24*a*, 24*b* which will be described below is provided on long side surfaces which are connected to the back end surface of the back end portion 21*c* of the nozzle chip 21. Each manifold 22*a*, 22*b* is attached to each of the long side surfaces of the nozzle chip 21.

A piezoelectric element for generating a pressure to jet ink is built in each nozzle of the nozzle chip 21. The piezoelectric element connected to each nozzle of one nozzle line is driven by a driving circuit mounted on the driving circuit substrate 25*a* which will be described below. The piezoelectric element connected to each nozzle of the other nozzle line is driven by a driving circuit mounted on the driving circuit substrate 25*b* which will be described below.

Thus, each driving circuit substrates 25*a*, 25*b* are connected to each side surfaces of the nozzle chip 21 through each of the first flexible wiring substrates 24*a*, 24*b*.

The manifolds 22*a*, 22*b* are a member to function as a branch pipe which supplies ink by branching ink led from outside through the ink flow pat connector 20*m* of the housing frame 20 and the ink flow path inside of the ink flow path fanning portion 20*n* to each nozzle of the nozzle chip 21.

Filter mounting portions at a2 are provided on the side surface side of the nozzle chip 21 of the manifolds 22*a*, 22*b*. A filter a3 is attached on the filter mounting portion al, and a filter a4 is attached on the filter moinning portion a2. Each of the filters a3, a4 is preferably attached to the filter mounting portions at a2, respectively, by thermocompression or adhesion. The filter mounting portion al and a2 are shown in FIG. 3 and FIG. 2, respectively.

The cap receiving plate 23 is a member attached to the lower end of the nozzle chip 21 and the manifolds 22*a*22*b*. The cap receiving plate 23 contacts with the suction cap S or the moisture retaining cap 14. The nozzle side surface 21*b* is exposed Through the opening 23*a* which is provided in the cap receiving plate 23 when the cap receiving plate 23 is attached to the lower portidn of the nozzle chip 21 and the manifolds 22*a*, 22*b*.

The first flexible wiring substrates 24*a*, 24*b* which are connected to the electrode of the nozzle chip 21 are for electrically connecting the nozzle chip 21 and the driving circuit substrate 25*a* and so forth. The first flexible wiring substrates 24*a*, 24*b* are connected to the driving circuit substrates 25*a*, 25*b* which will be described below, and are electrically connected to outside through the internal connectors 26*a*, 26*b*, the external connector 27 or the like.

The electrical connection of the driving circuit substrates 25*a*, 25*b* to outside is carried out by the internal connectors 26*a*, 26*b* the external connector 27, and the second flexible wiring substrate 29.

The internal connectors 26*a*, 26*b* are each mounted on the driving circuit substrates 25*a*, 25*b*. An external electrode of the second flexible wiring substrate 29 is connected to the external connector 27. A portion of the second flexible wiring substrate 29 including the external electrode is affixed on the wiring supporting plate 28 to be supported. The end of the second flexible wiring substrate 29 is bifurcated while extending from the wiring supporting plate 28. An internal electrode is formed on each chip of the bifurcated ends of the second flexible wiring substrate 29. The internal electrodes are connected to each of the internal connectors 26*a*, 26*b*. When in mounting the ink jet head 2, the external connector 27 is connected to a connector provided on the carriage 3.

When the cover 30 is attached to the housing frame 20, four side surfaces and upper end surface (a surface opposite to the nozzle side surface 21*b*) of a head housing are formed. An opening for holding connector 30*a* is formed on an end surface of the cover 30 which forms the upper end surface of the head housing. When the cover 30 is attached to the housing frame 20, the external connector 27 and the wiring supporting plate 28 are held by the opening for holding connector 30*a*.

The nozzle chip sandwiching portions 20*f*, 20*g* of the housing frame 20 which are the main portion of the present invention will be described referring to FIGS. 4–6B.

Figure 4:
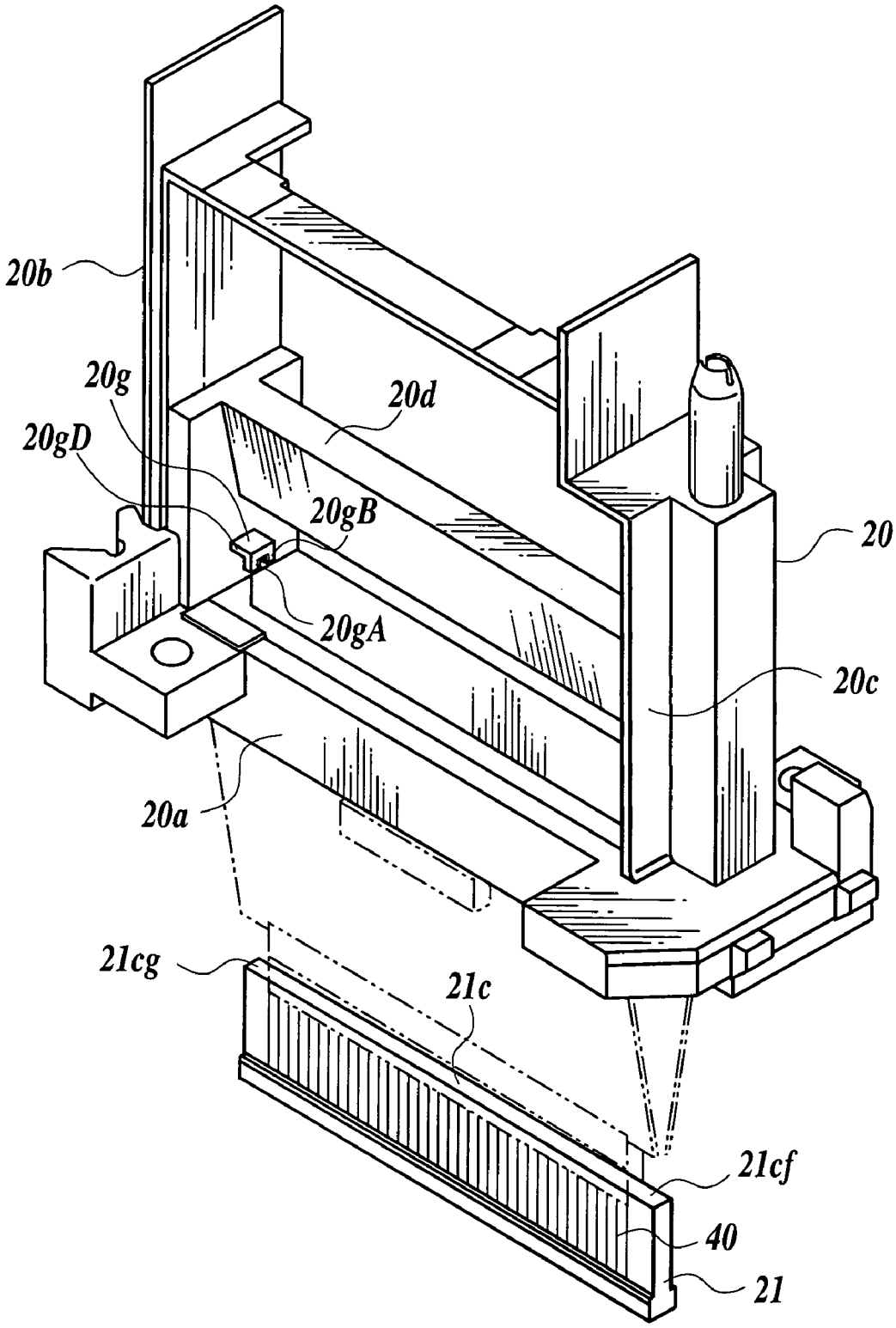
FIG. 4 is an enlarged perspective view showing the housing frame which forms the ink jet head and the nozzle chip before being fixed to the housing frame according to the first embodiment of the present invention.
Figure 5:
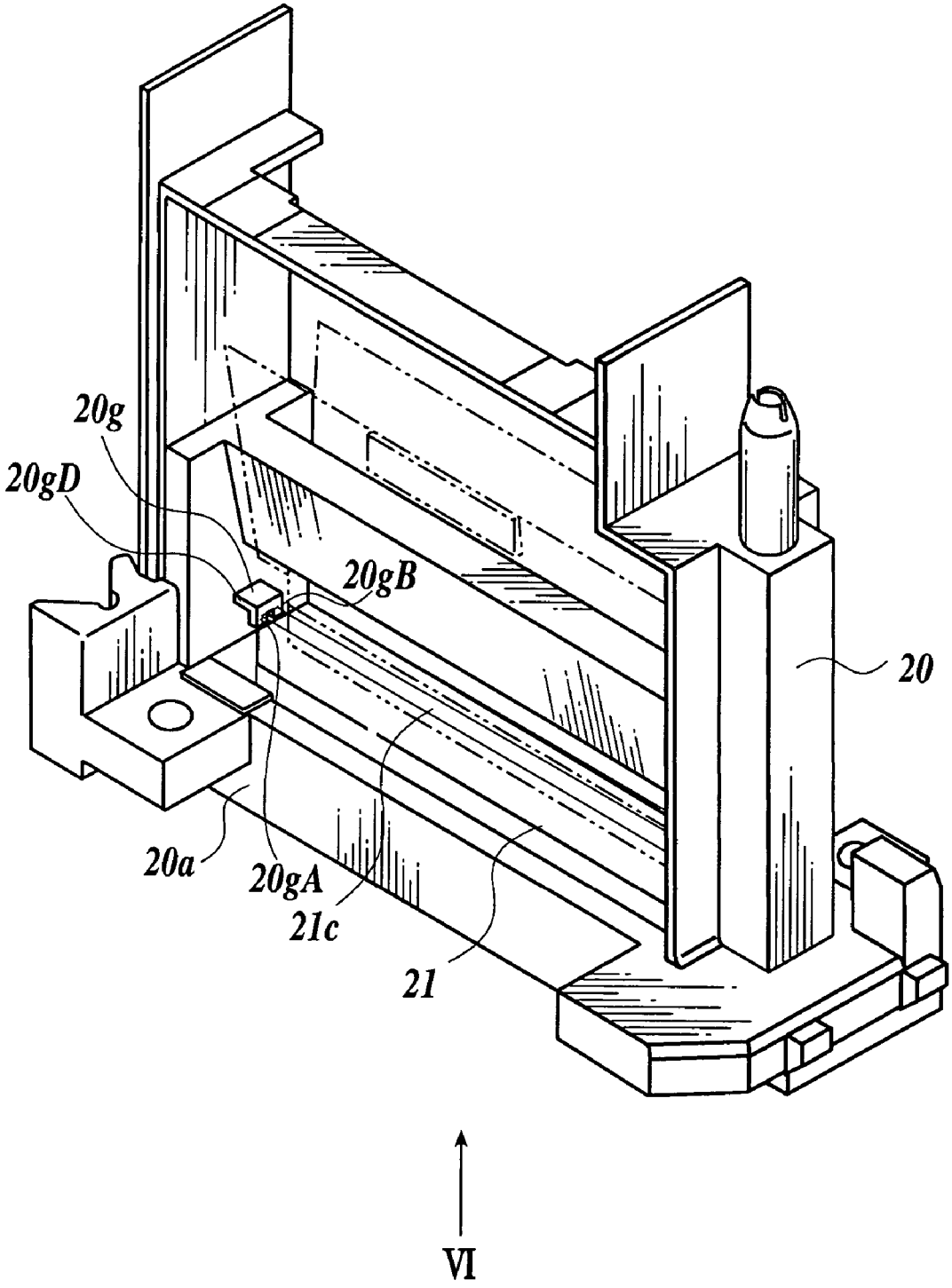
FIG. 5 is an enlarged perspective view showing the state in which a nozzle chip is fixed to a housing frame which forms the ink jet head according to the first embodiment of the present invention.
Figure 6A:
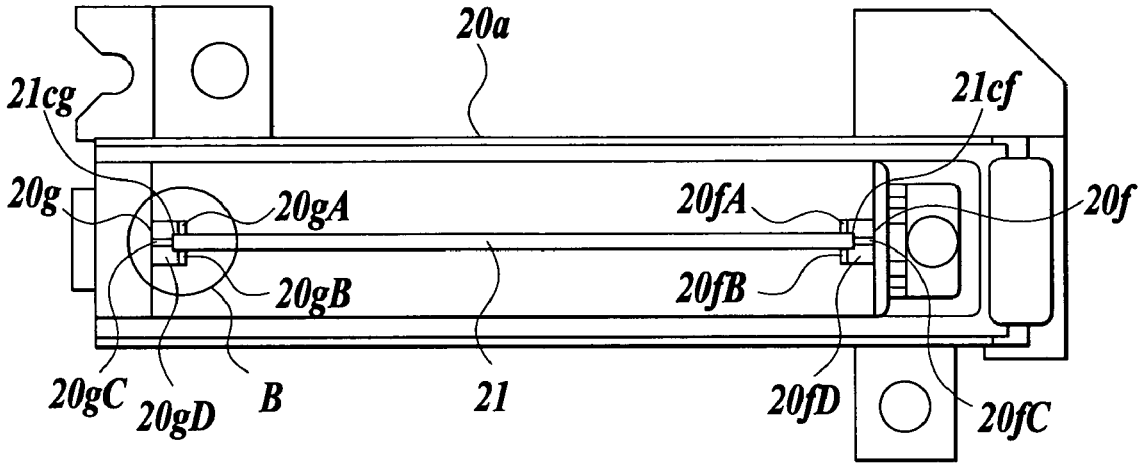
FIG. 6A is a view of the housing frame and the nozzle chip shown in FIG. 5 seen from the direction of the arrow VI.

FIG. 4 is an enlarged perspective view showing the housing frame 20 and the nozzle chip 21 before being fixed to the housing frame 20, and FIG. 5 is an enlarged perspective view showing the state in which the nozzle chip 21 is fixed to the housing frame 20. FIG. 6A is a view of the housing frame 20 and the nozzle chip 21 shown in FIG. 5 seen from the direction of the arrow VI, and FIG. GB is an enlarged view of the B portion in FIG. 6A.

The nozzle chip sandwiching portions 20*f*, 20*g* mean a first protrusion member and a second protrusion member provided inside of each of the side wall portions 20*b*, 20*c* of the housing frame 20. The nozzle chip sandwiching portions 20*f*, 20*g* function, as described above, to sandwich and hold each end of the back end portion 21*c* of the nozzle chip 21. In the present invention, the back end portion 21*c* of the nozzle chip 21 means an end portion which is opposite to the nozzle side surface 21*b* of the nozzle chip 21, and comprises a back end surface and a portion of the four side surfaces connected to and adjacent to the back end surface.

As shown in FIGS. 4 and 5, a plurality of protrusions (20*g*A, 20*g*B and so forth) is provided on a substantially rectangular-shaped flat plate portion 20*g*D downwardly to form the nozzle chip sandwiching portion 20*g*. The nozzle chip sandwiching portion 20*f* which is not shown in FIGS. 4 and 5 also has the structure same as the nozzle chip sandwiching portion 20*g*. In the embodiment, the housing frame 20 is formed by die-casting. A flat plate portions 20*f*, 20*g* are formed by carrying out cutting process on a substantially cuboid-shaped member which is formed inside of each of the side wall portions 20*l*, 20*c* of the housing frame 20.

The protrusions group shown in FIGS. 4 and 5 which is provided on the flat plate portion 20*g*D of the nozzle chip sandwiching portion 20*g* downwardly functions to sandwich and hold the back end portion 21*c* of the nozzle chip 21. The protrusions group will be explained below referring to FIGS. 6A and 6B.

The nozzle chip sandwiching portion 20*f* as shown in FIGS. 6A comprises a long side sandwiching protrusion pair 20*f*A, 20*f*B which are opposing each other so as to sandwich and hold one end 21*cf* of the long side surfaces which are connected to the back end surface of the back end portion 21*c* of the nozzle chip 21. The nozzle chip sandwiching portion 20*g* as shown in FIGS. 4–6B comprises a long side sandwiching protrusion pair 20*g*A, 20*g*B which is opposing each other so as to sandwich and hold the other end 21*cg* of the long side surfaces which are connected to the back end surface of the back end portion 21*c* of the nozzle chip 21.

The long side sandwiching protrusion pairs 20/A, 20/B and 20gA, 20gB mean a first protrusion pair in the present invention.

Any of the long side sandwiching protrusion pairs 20/A, 20/8 and 20gA, 20gB sandwich the portion of the long side surfaces which are connected to the back end surface of the back end portion 21c of the nozzle chip 21, excluding a portion on which an electrode (electrode terminal) 40 is provided.

Figure 6B:
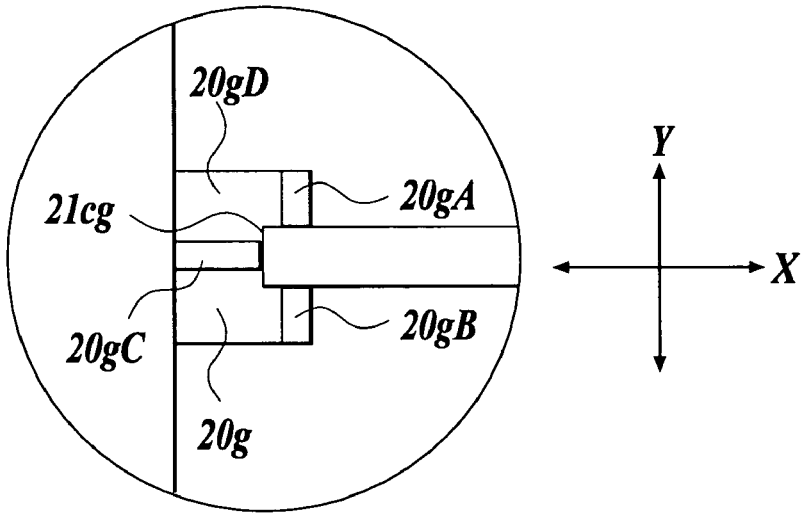

The nozzle chip sandwiching portions 20f, 20g as shown in FIGS. 6A and 6B also comprises a short side sandwiching protrusion pair 20/C, 20gC which is opposing each other so as to sandwich and hold short side surfaces which are connected to the back end surface of the back end portion 21c of the nozzle chip 21. The short side sandwiching protrusion pair 20/C, 20gC means a second protrusion pair in the present invention.

The one end 21cf of the long side surfaces which are connected to the back end surface of the back end portion 21c of the nozzle chip 21 is sandwiched and held by the long side sandwiching protrusion pair 20/A, 20/B. The other end 21cg of the long side surfaces which are connected to the back end surface of the back end portion 21c of the nozzle chip 21 is sandwiched and held by the long side sandwiching protrusion pair 20gA, 20gB. Thus, the relative position of the nozzle chip 21 to the housing frame 20 in the Y direction in FIG. 6B can be detennined.

The short side surfaces which are connected to the back end surface of the back end portion 21c of the nozzle chip 21 are sandwiched and held by The short side sandwiching protrusion pair 20/C, 20gC. Thus, the relative position of the nozzle chip 21 to the housing frame 20 in the X direction in FIG. 6B can be determined.

That is, the back end portion 21c of the nozzle chip 21 is sandwiched and held by the long side sandwiching protrusion pairs 20/A, 20/B and 20gA, 20gB and the short side sandwiching protrusion pair 20/C, 20gC which are provided on the nozzle chip sandwiching portions 20f, 20g of the housing frame 20. Thus, the relative position in a horizontal direction of the nozzle chip 21 to the housing frame 20 can be determined (refer to FIGS. 5, 6A and 6B).

Further, the substantially rectangular-shaped flat plate portions 20/D, 20gD which form the nozzle chip sandwiching portions 20f, 20g are for determining the relative position in a vertical direction of the nozzle chip 21 to the housing frame 20. The flat plate portions 20/D, 20gD will be explained below.

The flat plate portion 20gD of the nozzle chip sandwiching portion 20g, as shown in FIG. 5, functions to make the back end surface of the back end portion 21c of the nozzle chip 21 abut on the nozzle chip sandwiching portion 20g. The flat plate portion 20/D of the nozzle chip asadwiching portion 20f which is not shown in FIGS. 4 and 5 also functions to make the back end surface of the back end portion 21c of the nozzle chip 21 abut on the nozzle chip sandwiching portion 20f. Each of the flat plate portions 20/D, 20gD means an abutment portion in the present invention.

The back end surface of the back end portion 21c of the nozzle chip 21 abuts on the flat plate portions 20/D, 20gD of the nozzle chip sandwiching portions 20f, 20g. Thus, the relative position in a vertical direction of the nozzle chip 21 to the housing frame 20 can be determined (refer to FIGS. 5, 6A and 6B).

In the ink jet head 2 according to the embodiment, the long side surfaces adjacent to the back end surface of the back end portion 21c of the nozzle chip 21 are sandwiched by each of the long side sandwiching protrusion pairs 20/A, 20/B and 20gA, 20gB provided on the nozzle chip sandwiching portions 20f, 20g, and the short side surfaces adjacent to the back end surface of the nozzle chip 21c of the nozzle chip 21 are sandwiched by the short side sandwiching protrusion pair 20/C, 20gC. Thus the nozzle chip 21 can be positioned properly to the housing frame 20 in a horizontal direction.

In the ink jet head 2 according to the embodiment, since the long side sandwiching protrusion pairs 20/A, 20/B and 20gA, 20gB provided on the nozzle chip sandwiching portions 20f, 20g abut in the vicinity of each end of the long side surfaces excluding a portion on which the electrode terminal is disposed to sandwich the nozzle chip 21, the nozzle chip 21 can be positioned to the housing frame 20 more properly, and this allows other members to be connected to the electrode tenninal.

In the ink jet head 2 according to the embodiment, since the back end surface of the back end portion 21c of the nozzle chip 21 is abutted on the flat plate poitions 20/D, 20gD of the nozzle chip sandwiching portions 20f, 20g of the nozzle chip 21 the nozzle chip 21 can be positioned properly to the housing frame 20 in a vertical direction.

In the ink jet head 2 according to the embodiment, since the nozzle chip 21 can be positioned properly only by forming a specific protrusions group and a flat portion by carrying out cutting process on a portion of the housing frame 20, it is unnecessary to carry out cutting process in wide area on the housing frame as the earlier technique. Accordingly, the time and cost for cutting process are extremely reduced.

In the ink jet printer 1 according to the embodiment, since the ink jet head 2 is mounted to the carriage 3 in a state prepositioned, the relative position relation of the nozzle chip 21 to the carriage 3 can be fixed. Thus, displacement of the ink jetting position can be prevented and an image with a high accuracy can be formed.

Second Embodiment

The ink jet printer according to the second embodiment will be described referring to FIGS. 7A and 7B. In die ink jet printer 1 according to the present embodiment, only the structure of the nozzle chip sandwiching portions 20f, 20g of the housing frame 20 of the ink jet head 2 is changed in comparison with the ink jet printer 1 according to the first embodiment, and other structures are substantially the same as those of the first embodiment. In the following explanation, the same references are attached to structural members, elements or the like corresponding to the ink jet printer i in the first embodiment.

Figure 7A:
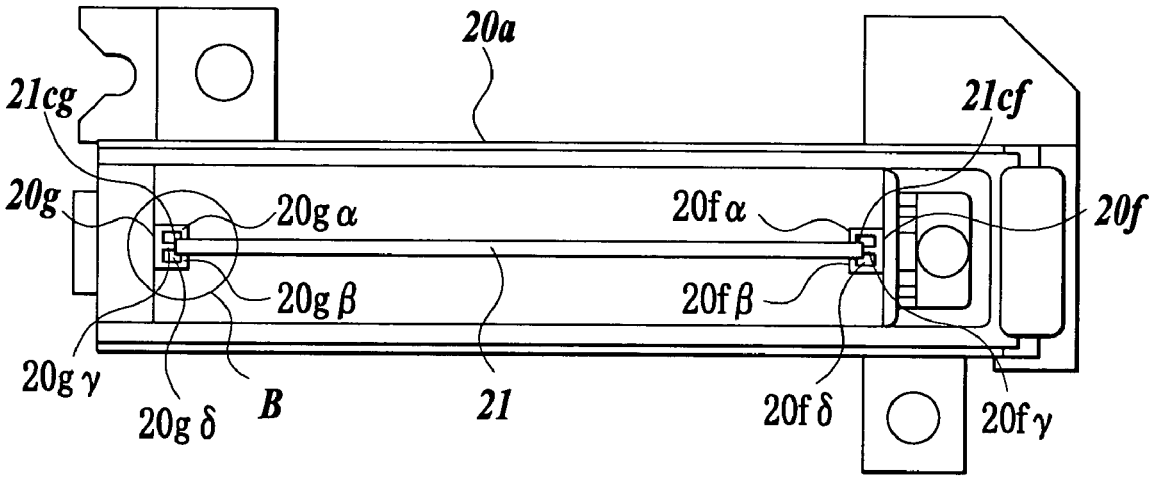
FIG. 7A is a view showing the housing frame which forms the ink jet head and the nozzle chip fixed to the housing frame seen from below according to the second embodiment of the present invention.

FIG. 7A is a view showing the housing frame 20 and the nozzle chip 21 fixed to the housing frame seen from below, like FIG. 6B. FIG. 7B is an enlarged view of the B portion in FIG. 7A.

In the embodiment, the nozzle chip sandwiching portion 20g comprises a flat plate portion 20gδ and a particular shap of protrusion (20gα, 20gβ and so forth) which are provided on the flat plate portion 20gδ downwardly. In the embodiment, the housing frame 20 is formed by die-casting. A flat plate portion and a protrusion of nozzle chip sandwiching portion 20f, 20g are formed by carrying out cutting process on a substantially cuboid-shaped member which is formed inside of each of the side wall portions 20b, 20c of the housing frame 20.

Figure 7B:
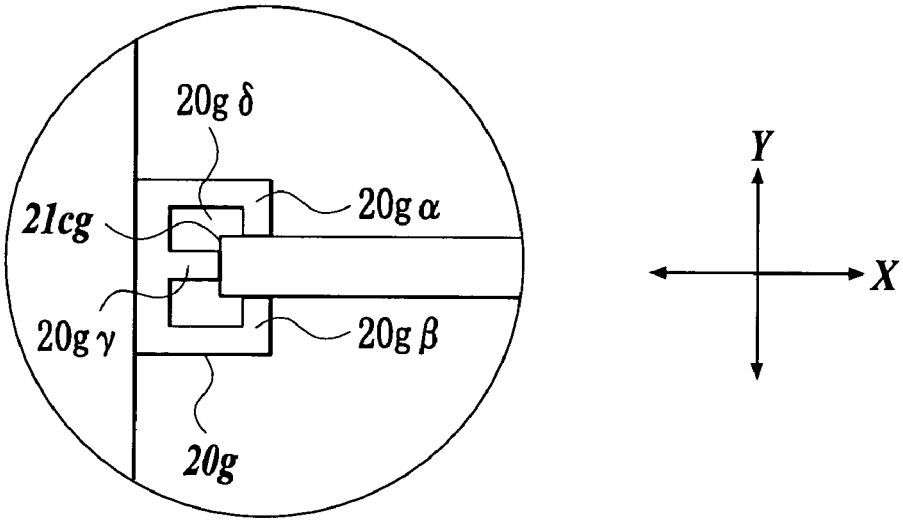
FIG. 7B is an enlarged view of the B portion shown in FIG. 7A.
Figure 8:
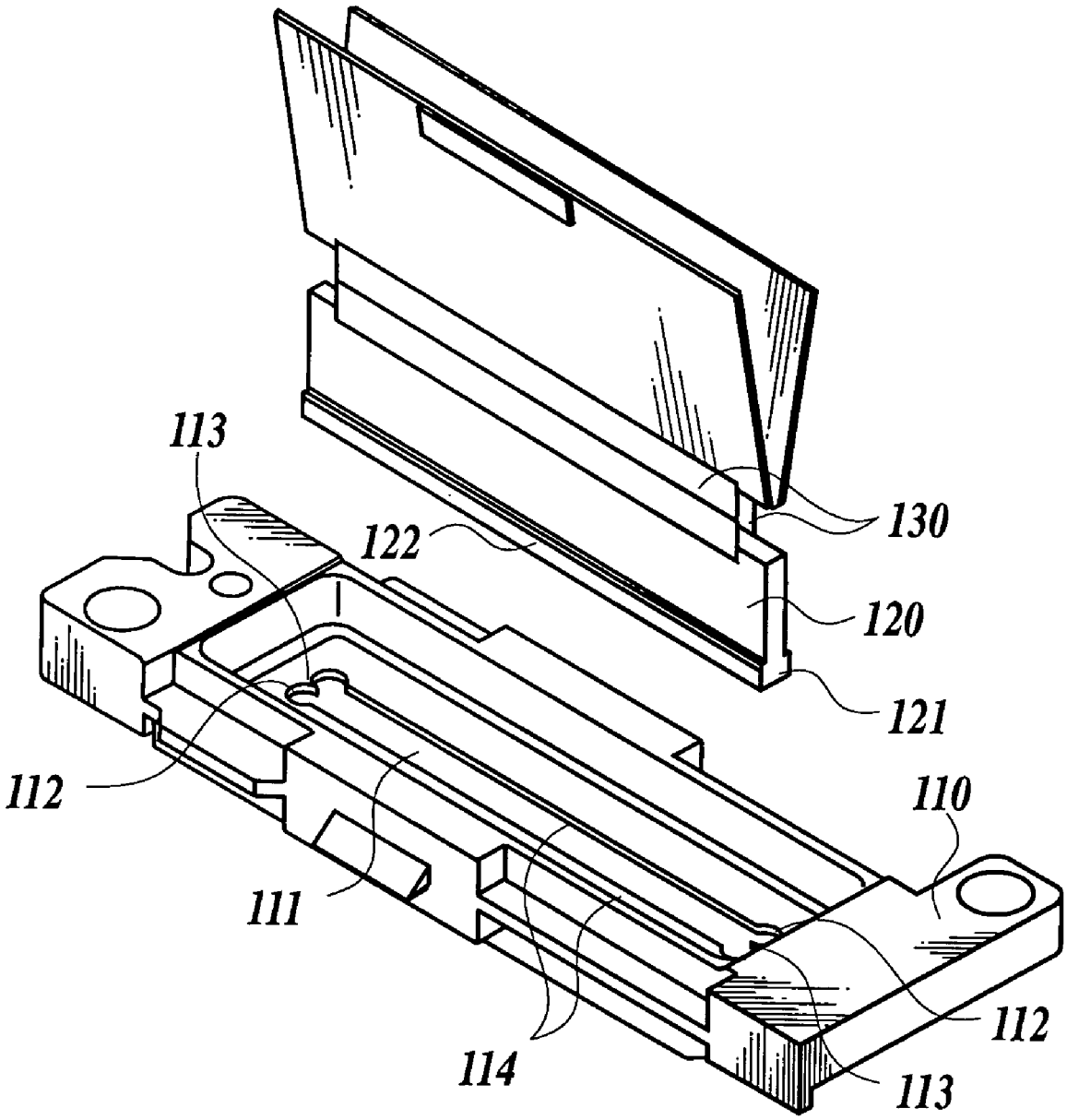
FIG. 8 is an exploded perspective view for explaining a portion of the structure of an ink jet head according to an earlier technique developed by the applicant of the present invention.

The nozzle chip sandwiching portion 20g in the embodiment, as shown in FIGS. 7A and 7B, comprises a long side sandwiching protrusion pair 20$g\alpha$, 20$g\beta$ which is opposing each other so as to sandwich and hold the one end 21$cg$ of the long side surfaces which are connected to the back end surface of the back end portion 21$c$ of the nozzle chip 21. The nozzle chip sandwiching portion 20$f$, as shown in FIGS. 7A, also comprises a long side sandwiching protrusion pair 20$f\alpha$, 20$f\beta$ which is opposing each other so as to sandwich and hold the other end 21$cf$ of the long side surfaces which are connected to the back end surface of the back end portion 2$k$ of the nozzle chip 21.

The long side sandwiching protrusion pairs 20$f\alpha$, 20$f\beta$ and 20$g\alpha$, 20$g\beta$ mean a first protrusion pair in the present invention.

Any of the long side sandwiching protrusion pairs 20$f\alpha$, 20$f\beta$ and 20$g\alpha$, 20$g\beta$ sandwiches the portion of the long side surfaces which are connected to the back end surface of the back end portion 21$c$ of the nozzle chip 21, excluding a portion on which an electrode (electrode terminal) 40 is provided.

The nozzle chip sandwiching portion 20$f$, 20$g$, as shown in FIGS. 7A and 7B, comprises a short side sandwiching protrusion pair 20$f\gamma$, 20$g\gamma$ which is opposing each other to sandwich and hold the short side surfaces which are connected to the back end surface of the back end portion 21$c$ of the nozzle chip 21.

The short side sandwiching protrusion pair 20$f\gamma$, 20$g\gamma$ means a second protrusion pair in the present invention.

In the embodiment, cutting process is carried out so as to link the long side sandwiching protrusion pair 20$f\alpha$, 20$f\beta$ to the short side sandwiching protrusion pair 20$f\gamma$, and to link the long side sandwiching protrusion pair 20$g\alpha$, 20$g$ $\beta$ to the short side sandwiching protrusion pair 20$g\gamma$ as is apparent in FIGS. 7A and 7B.

The one end 21$cf$ of the long side surfaces which are connected to the back end surface of the back end portion 2$c$ of the nozzle chip 21 is sandwiched and held by the long side sandwiching protrusion pair 20$f\alpha$, 20$f\beta$. The other end 21$cg$ of the long side surfaces which are connected to the back end surface of the back end portion 21$c$ of the nozzle chip 21 is sandwiched and held by the long side sandwiching protrusion pair 20$g\alpha$, 20$g\beta$. Thus, the relative position of the nozzle chip 21 to the housing frame 20 in the Y direction in FIG. 7B can be determined.

The short side surfaces which are connected to the back end of the back end portion 21$c$ of the nozzle chip 21 are sandwiched and held by the short side sandwiching protrusion pair 20$f\gamma$, 20$g\gamma$. Thus, the relative position of the nozzle chip 21 to the housing frame 20 in the direction in FIG. 7B can be determined.

That is, the back end portion 21$c$ of the nozzle chip 21 is sandwiched and held by the long side sandwiching protrusion pairs 20$f\alpha$, 20$g\beta$ and 20$g\alpha$, 20$g\beta$ and the short side sandwiching protrusion pair 20$f\gamma$, 20$g\gamma$ which are provided on the nozzle chip sandwiching portions 20$f$, 20$g$ of the housing frame 20. Thus, the relative position in a horizontal direction of the nozzle chip 21 to the housing frame 20 can be determined (refer to FIGS. 7A and 7B).

The substantially rectangular-shaped flat plate portions 20$f\delta$, 20$f\delta$ which form the nozzle chip sandwiching portions 20$f$, 20$g$ are for determining the relative position in a vertical direction of the nozzle chip 21 to the housing frame 20. The flat plate portion 20$g\delta$ of the nozzle chip sandwiching portion 20$g$ functions to make the back end surface of the back end portion 21$c$ of the nozzle chip 21 abut on the nozzle chip sandwiching portion 20$g$. The flat plate portion 20$f\delta$ of the nozzle chip sandwiching portion 20$f\delta$ also functions to make the back end surface of the back end portion 21$c$ of the nozzle chip 21 abut on the nozzle chip sandwiching portion 20$f$. The flat plate portions 20$f\delta$, 20$g\delta$ mean an abutment portion in the present invention.

The back end surface of the back end portion 21$c$ of the nozzle chip 21 abuts on the flat plate portions 20$f\delta$, 20$g\delta$ of the nozzle chip sandwiching portions 20$f$, 20$g$. Thus, the relative position in a vertical direction of the nozzle chip 21 to the housing frame 20 can be determined (refer to FIGS. 7A and 7B).

In the ink jet head according to the embodiment, the long side surfaces adjacent to the back end surface of the back end portion 21$c$ of the nozzle chip 21 are sandwiched by each of the long side sandwiching protrusion pairs 20$f\alpha$, 20$f\beta$ and 20$g\alpha$, 20$g\beta$ provided on the nozzle chip sandwiching portions 20$f$, 20$g$, and the short side surfaces adjacent to the back end surface of the nozzle chip 21$c$ of the nozzle chip 21 by the short side sandwiching protrusion pair 20$f\gamma$, 20$g\delta$. Thus the nozzle chip 21 can be positioned properly to the housing frame 20 in a horizontal direction.

In the ink jet head according to the embodiment, since the long side sandwiching protrusion pairs 20$f\alpha$, 20$f\beta$ and 20$g\alpha$, 20$g\beta$ provided on the nozzle chip sandwiching portions 20$f$, 20$g$ abut in the vicinity of each end of the long side surfaces excluding a portion on which the electrode tenninal is disposed to sandwich the nozzle chip 21, the nozzle chip 21 can be positioned to the housing frame 20 more properly, and this allows other members to be connected to the electrode terminal.

In the ink jet head according to the embodiment since the back end surface of the back end portion 21$c$ of the nozzle chip 21 is abutted on the flat plate portions 20$f\delta$, 20$g\delta$ of the nozzle chip sandwiching portions 20$f$, 20$g$ of the nozzle chip 21, the nozzle chip 21 can be positioned properly to the housing frame 20 in a vertical direction.

In the ink jet head according to the embodiment, since the nozzle chip 21 can be positioned properly only by forming a specific protrusions group and a flat portion by carrying out cutting process on a portion of the housing frame 20, it is unnecessary to carry out cutting process for tine adjustment of the shape of the surface as the earlier technique. Accordingly, the time and cost for cutting process are extremely reduced.

In the ink jet printer according to the embodiment, since the ink jet head 2 is mounted to the carriage 3 in a state prepositioned, the relative position relation of the nozzle chip 21 to the carriage 3 can be fixed. Thus, displacement of the ink jetting position can be prevented and an image with a high accuracy can be formed.

In the embodiment, the nozzle chip sandwiching portions 20$f$, 20$g$ comprising the long side sandwiching protrusion pairs (first protrusion pain), the short side sandwiching protrusion pair (second protrusion pair) and the flat plate portions (abutment portion) of the shape as shown in FIGS. 6B and 7B are formed by carrying out cuffing process on a portion of the housing frame 2. A shape of the first protrusion pairs, the second protrusion pair and the abutment portion are not limited to the shape in the embodiments.

That is, the first protrusion pair may be any shape if the first protrusion pair is opposing each other so as to sandwich and hold the long side surfaces which are connected to the back end surface of the back end portion 21$c$ of the nozzle chip 21. Also, the second protrusion pair may be any shape if the second protrusion pair is opposing each other so as to sandwich and hold the short side surfaces which are connected to the back end surface of the back end portion 21$c$ of the nozzle chip 21. Further, the abutment portion may be any form if the abutment portion is to make the back end surface of the back end portion 21*c* of the nozzle chip 21 abut on the abutment portion.

The entire disclosure of Japanese Patent Application No. Tokugan 2002-256055 which was filed on Aug. 30, 2002, including specification, claims, drawings and summary are incorporated herein by reference in its entirety.

What is claimed is:

1. An ink jet head comprising:

a nozzle chip with a thin substantially rectangular parallelepiped plate shape, including: a front end surface in which a plurality of nozzles for jetting ink are provided, a back end surface opposed to the front end surface, which has a substantially rectangular shape with a pair of short sides each having a length substantially equal to a thickness of the substantially rectangular parallelepiped platte, and four side surfaces adjacent to the back end surface; and a frame shape member, to position and mount the nozzle chip thereon, including: a first protrusion pair which abuts on one pair of facing side surfaces extending in a lengthwise direction, of the four side surfaces, at positions in the vicinity of an end of the back end surface of the nozzle chip in a lengthwise direction to sandwich the nozzle chip, and a second protrusion pair which abuts on the other pair of facing sides surfaces of the nozzle chip, extending in a thickness direction, of the four side surfaces to sandwich the nozzle chip.

2. The ink jet head of claim 1, wherein the nozzle chip comprises an electrode terminal on a central portion of the one pair of facing sides, and the first protrusion pair abuts on a portion of the one pair of facing sides on which no electrode terminal is provided to sandwich the nozzle chip.

3. The ink jet head of claim 1, wherein the frame shape member comprises an abutment portion on which the back end surface of the nozzle chip abuts.

4. The ink jet head of claim 1, wherein the frame shape member comprises a first protrusion member and a second protrusion member on inner walls of both ends of the frame shape member, respectively, so as to face each other, the first protrusion member comprising the first protrusion pair a protrusion pair, the second protrusion member comprising the first protrusion pair and the other protrusion of the second protrusion pair.

5. The ink jet head of claim 4, wherein each of the first protrusion member and the second protrusion member further comprises an abutment portion on which the back end surface of the nozzle chip abuts.

6. The ink jet head of claim 5, wherein the first protrusion pair is arranged on the abutment portion perpendicularly.

7. The ink jet head of claim 5, wherein the second protrusion pair is arranged on the abutment portion perpendicularly.

8. The ink jet head of claim 1, wherein the frame shape member is made of at least one selected from aluminum, resin, magnesium and silver.

9. The ink jet head of claim 1, wherein the frame shape member is formed as one body by die-casting.

10. The ink jet head of claim 9, wherein the first protrusion pair and the second protrusion pair are formed by cutting process.

11. The ink jet head of claim 1, wherein the back end surface of the nozzle chip has a uniform thickness.

12. The ink jet head of claim 1, wherein a thickness of the back end surface of the nozzle chip is smaller than a thickness of the front end surface.

13. The ink jet head of claim 1, wherein a piezoelectric element of shear mode type is built in the ink jet head.

14. An ink jet printer comprising:

an ink jet head which comprises a nozzle chip with a thin substantially rectangular parallelepiped plate shape, including: a front end surface in which a plurality of nozzles for jetting ink are provided, a back end surface opposed to the front end surface, which has a substantially rectangular shape with a pair of short sides each having a length substantially equal to a thickness of the substantially rectangular parallelepiped plate, and four side surfaces adjacent to the back end surface; and a frame shape member to position and mount the nozzle chip thereon, including: a first protrusion pair which abuts on one pair of facing sides surfaces extending in a lengthwise direction of the four side surfaces at positions in the vicinity of an end of the back end surface of the nozzle chip in a lengthwise direction to sandwich the nozzle chip, and a second protrusion pair which abuts on the other pair of facing sides surfaces of the nozzle chip, extending in a thickness direction, of the four side surfaces to sandwich the nozzle chip; and a carriage on which the ink jet head is mounted in a state pre-positioned.

15. The ink jet printer of claim 14, wherein the nozzle chip comprises an electrode terminal on a central portion of the one pair of facing sides, and the first protrusion pair abuts on a portion of the one pair of facing sides on which no electrode terminal is provided to sandwich the nozzle chip.

16. The ink jet printer of claim 14, wherein the frame shape member comprises an abutment portion on which the back end surface of the nozzle chip abuts.

17. The ink jet printer of claim 14, wherein the frame shape member comprises a first protrusion member and a second protrusion memo of both ends of the frame shape member, respectively, so as to face each other, protrusion member comprising the first protrusion pair and one protrusion of the second protrusion pair, the second protrusion member comprising the first protrusion pair and the other protrusion of the second protrusion pair.

18. The ink jet printer of claim 17, wherein each of the first protrusion member and the second protrusion member further comprises an abutment portion on which the back end surface of the nozzle chip.

19. The ink jet printer of claim 18, wherein the first protrusion pair is arranged on the abutment portion perpendicularly.

20. The ink jet printer of claim 18, wherein the second protrusion pair is arranged on the abutment portion perpendicularly.

21. The ink jet printer of claim 14, wherein the frame shape member is made of at least one selected from aluminum, resin, magnesium and silver.

22. The ink jet printer of claim 14, wherein the frame shape member is formed as one body by die-casting.

23. The ink jet printer of claim 22, the first protrusion pair and the second protrusion pair are formed by cutting process.

24. The ink jet printer of claim 14, wherein the back end surface of the nozzle chip has a uniform thickness.

25. The ink jet printer of claim 14, wherein a thickness of the back end surface of the nozzle chip is smaller than a thickness of the front end surface.

26. The ink jet printer of claim 14, wherein a piezoelectric element of shear mode type is built in the ink jet head.

* * * * *